US005216397A

United States Patent [19]

Matsuoka et al.

[11] Patent Number: 5,216,397

[45] Date of Patent: Jun. 1, 1993

[54] ELECTROMAGNETIC RELAY HAVING AN IMPROVED TERMINAL PIECE STRUCTURE

[75] Inventors: Kazushige Matsuoka, Mishima; Masaharu Nakagawa, Yamaga, both of Japan

[73] Assignee: Omron Corporation, Kyoto, Japan

[21] Appl. No.: 554,516

[22] Filed: Jul. 20, 1990

[30] Foreign Application Priority Data

Jul. 20, 1989 [JP] Japan ..... 1-190294
Nov. 9, 1989 [JP] Japan ..... 1-291454

[51] Int. Cl.[5] ..... H01H 51/22
[52] U.S. Cl. ..... 335/83; 335/78
[58] Field of Search ..... 335/78-86, 335/124, 128, 202

[56] References Cited

U.S. PATENT DOCUMENTS 4,688,010 8/1987 Nobutoki et al. ..... 335/128
5,041,870 8/1991 Imai et al. ..... 335/83

FOREIGN PATENT DOCUMENTS 0281950 9/1988 European Pat. Off. .
2618601 1/1989 France .
2069765 8/1981 United Kingdom .

*Primary Examiner*—Lincoln Donovan
*Attorney, Agent, or Firm*—Fish & Richardson

[57] ABSTRACT

An electromagnetic relay comprising a fixed end terminal piece including a main part, a narrowed portion extending therefrom, and a relatively broader mounting portion formed at a free end of the narrowed portion and carrying a fixed contact thereon. Since a strong magnetic field in generated by the concentration of electric current in the narrowed portion, and an electric arc generated across the contacts is subjected to a corresponding electromagnetic force according to Fleming's left-hand rule, the arc is either eliminated or deflected from the shortest path between the two contacts, and the welding together of the two contacts is effectively prevented. Also, the durability of the contacts is substantially improved through deflection or elimination of the arc.

6 Claims, 6 Drawing Sheets

ELECTROMAGNETIC RELAY HAVING AN IMPROVED TERMINAL PIECE STRUCTURE

TECHNICAL FIELD

The present invention relates to an electromagnetic relay having an improved terminal piece structure.

BACKGROUND OF THE INVENTION

In conventional electromagnetic relays, when a moveable contact moves away from a fixed contact, an electric arc is often generated across the contacts. The resulting heat melts the contacts to a certain extent, and this substantially reduces the service life of the electromagnetic relay. In some cases, the contacts may be welded together by this heat, thereby rendering the electromagnetic relay totally unusable.

An electromagnetic relay typically consists of a casing, an electromagnet unit received in the casing and including an electromagnetic coil, and a contact unit which is also received in the casing and actuated by the electromagnet unit. In small relays, the casing is so small that the coil leads of the electromagnetic coil and the terminal pieces of the contact unit are required to be arranged undesirably close together. When the exposed parts of the coil leads and the terminal pieces are arranged close together, it become increasingly difficult to ensure a sufficient insulation therebetween over the entire service life of the electromagnetic relay.

BRIEF SUMMARY OF THE INVENTION

In view of such problems of the prior art, a primary object of the present invention is to provide an electromagnetic relay which is durable.

A second object of the present invention is to provide an electromagnetic relay having a contact mechanism which is relatively free from the adverse effects of electric arc which may be generated across its contacts as they move away from each other.

A third object of the present invention is to provide an electromagnetic relay which can ensure a favorable electric insulation between its coil leads and its terminal pieces.

These and other objects of the present invention can be accomplished by providing An electromagnetic relay, comprising a casing, an electromagnet block received in the casing, and a contact unit provided in an upper part of the casing so as to be actuated by the electromagnet unit, the contact unit comprising: a fixed end terminal piece secured in the casing and provided with a mounting portion carrying a fixed contact; a moveable end terminal piece secured in the casing; a movable contact piece resiliently supported by the moveable end terminal piece at its base end and carrying a moveable contact at its free end for selective engagement with the fixed contact in cooperation with the electromagnet unit; the mounting portion being provided with a narrowed portion having a narrower width than a main part of the mounting portion at its base end.

Thus, since a strong magnetic field in generated by the concentration of electric current in the narrowed portion, and an electric arc generated across the contacts is subjected to a corresponding electromagnetic force according to Fleming's left-hand rule, the arc is either eliminated or deflected from the shortest path between the two contacts, and the welding together of the two contacts is effectively prevented.

Also, the durability of the contacts is substantially improved. This magnetic field can be even more intensified when the narrowed portion includes a section which extends along one side of the fixed contact.

The provision of such a narrowed portion offers the additional advantage of preventing the displacement and deformation of the mounting portion when external force such as pushing force is applied to the fixed end terminal piece. Therefore, the reliability of the contact unit can be substantially improved.

According to a preferred embodiment of the present invention, the casing is provided with a first side defining an open end for receiving the electromagnet block therefrom, and the contact unit is disposed in an upper part of the casing, the terminal pieces extending from the upper part to a lower part of the casing along grooves defined in a second side of the casing remote from the first side. Preferably, the casing is box-shaped, and the grooves are defined along ridges on either side of the second side of the casing.

According to this embodiment, since a sufficient distance is ensured between the coil leads and the terminal pieces, a favorable electric insulation is ensured therebetween over its entire service life. each of the terminal pieces extends vertically entirely across the casing, and each of upper and lower extreme ends of each of the terminal pieces projects from the casing to form a terminal for connection with an external circuit.

Typically, the mounting portion extends along a plane perpendicular to a vertical direction of the casing. In this case, if the casing is provided with a recess for receiving the mounting portion and side walls of the recess abut side edges of the mounting portion from two mutually perpendicular directions, the fixed contact carried by the mounting portion can be favorably located in a stable fashion even when external ends of the terminal piece is subjected to an external force.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
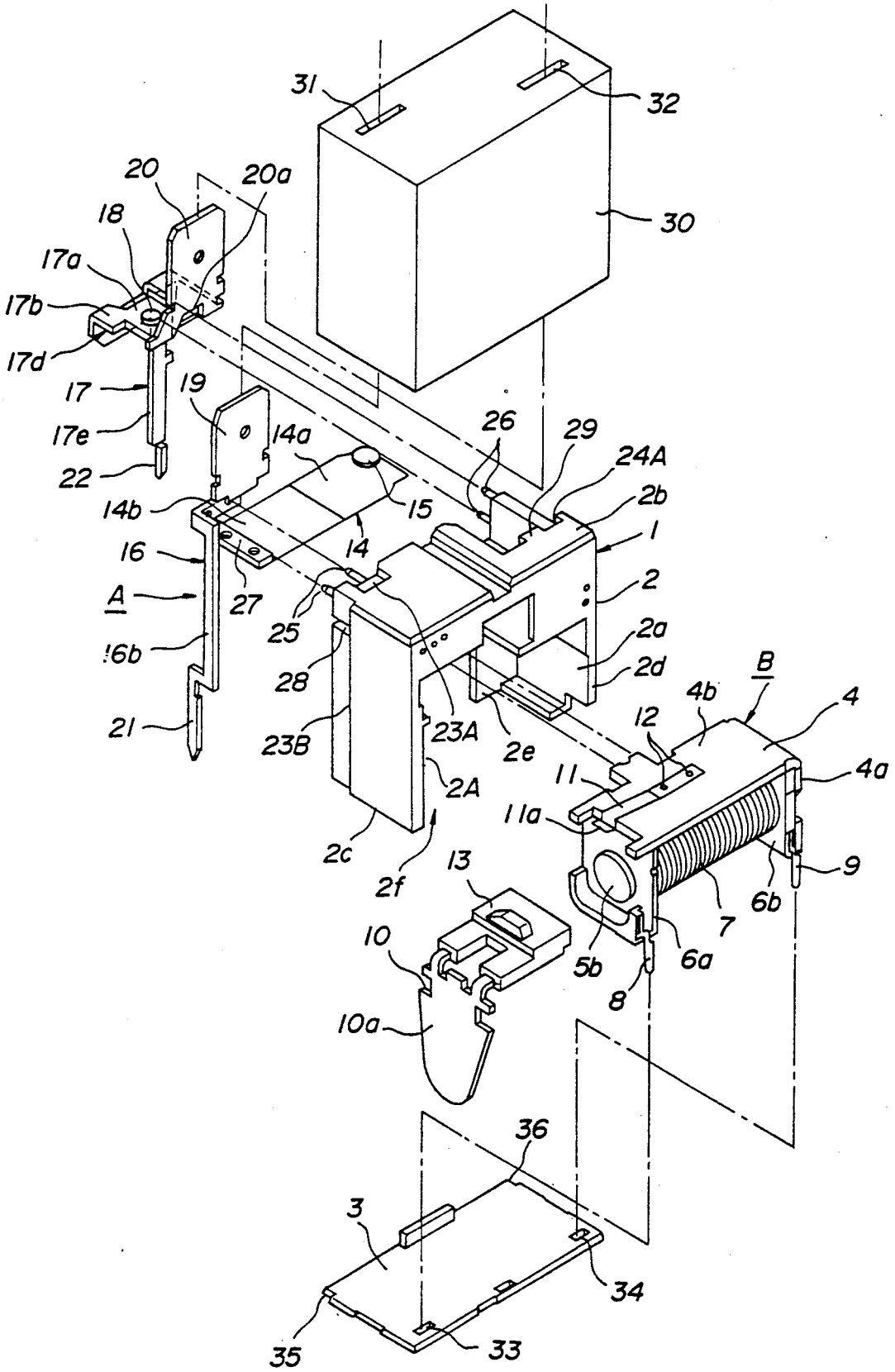
FIG. 1 is an exploded perspective view of a preferred embodiment of the electromagnetic relay according to the present invention.
Figure 2:
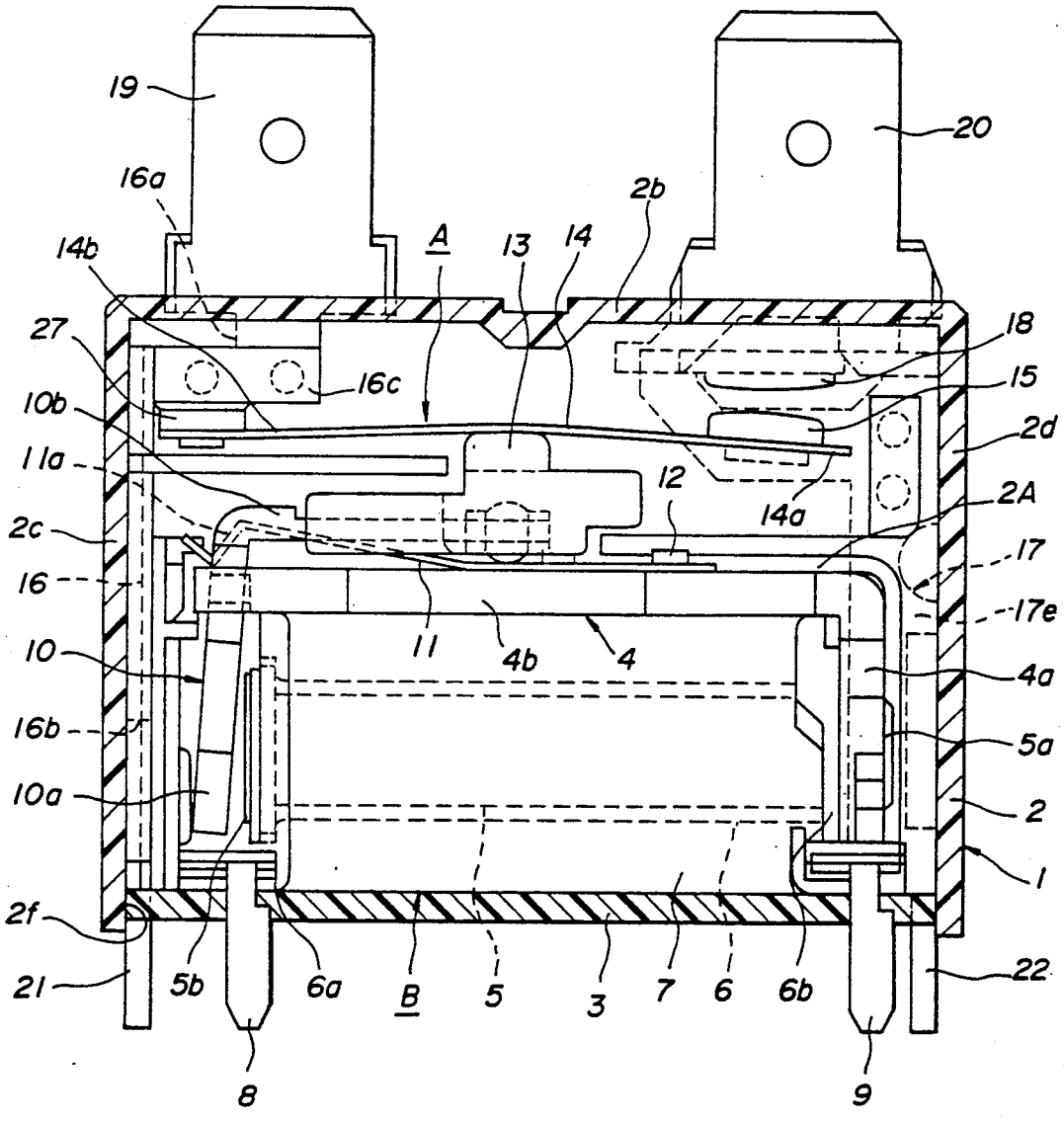
FIG. 2 is a sectional view of this electromagnetic relay with its cover removed.
Figure 3:
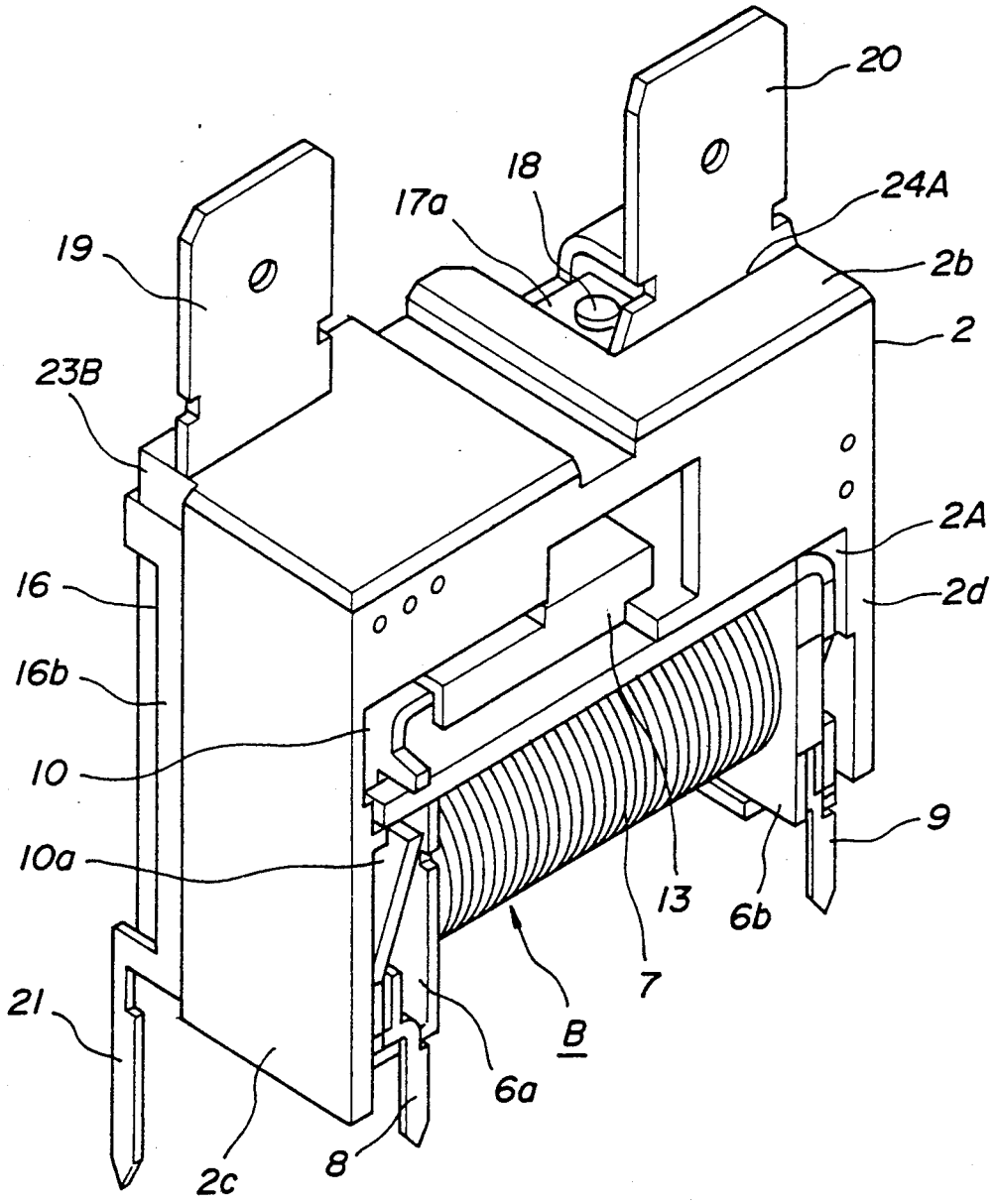
FIG. 3 is a front perspective view of the internal structure of this electromagnetic relay.

Referring to FIGS. 1 and 2 generally depicting a preferred embodiment of the present invention, a casing 1 consists of a casing main body 2, a bottom lid 3, and a cover 30, and accommodates inside its recess 2A a contact mechanism A and an electromagnet unit B. The casing main body 2 is generally box-shaped, and is provided with a top wall 2*b*, a pair of side walls 2*c* and 2*d*, and a rear wall 2*e*, defining a front opening 2*a* and a bottom opening 2*f*. The contact unit A is generally received in various recesses provided in the upper wall 2*b*, and the electromagnet unit B is generally accommodated in the recess 2A defined in the casing main body 2. The bottom opening 2*f* of the casing main body 2 is closed by the bottom lid 3, and the entire casing main body 2 is encased in an outer casing formed by the cover 30 and the bottom lid 3.

The electromagnet unit B comprises an L-shaped yoke 4 consisting of a first leg 4*a* extending vertically in the recess 2A along one of the side walls 2*d*, and a second leg 4*b* bent perpendicularly from the first leg 4*a* and extending across the recess 2A along the upper wall 2*b*, an iron core 5 fixedly secured to the first leg 4*a* of the yoke 4 by crimping at its one end 5*a*, and extending in parallel with the second leg 4*b* of the yoke 4, and an electromagnetic coil 5 wound around the iron core 5 by way of a coil spool 6. An L-shaped armature 10 is pivotally supported by a free end of the second leg 4*b* of the yoke 4 by means of a hinge spring 11 which is fixedly secured to the yoke 4 at its base end by rivets 12 and bears upon the armature 10 at its free end 11*a* in such a manner that a main part 10*a* of the armature 10 opposing a magnetic pole 5*b* defined at a free end of the iron core 5 may be biased away from the magnetic pole 5*b*. The other leg 10*b* of the armature 10 is provided with a card 13 made of synthetic resin for actuating the contact unit A as described hereinafter. The spool 6 is provided with flanges 6*a* and 6*b* on either longitudinal end thereof, and coil lead terminals 8 and 9 project downward from lower front ends of the flanges 6*a* and 6*b*, respectively. The bottom lid 3 is provided with openings 33 and 34 for passing these coil lead terminals 8 and 9 out of the casing 1.

The contact mechanism A comprises a moveable end terminal piece 16 carrying a moveable contact piece 14, and a fixed end terminal piece 17.

The moveable end terminal piece 16 is provided with a tab terminal 19 at its upper end, a neck portion 16*a* bent rearward from the base end of the tab terminal 19 and received in a recess 23A provided in the upper wall 2*b*, a main part 16*b* extending downward from the neck portion 16*a* and received in a groove 23B formed along a corner portion between the rear wall 2*e* and one of the side walls 2*c*, and a connecting terminal 21 formed at the lower end of the main part 16*b*. The cover 30 is provided with an opening 31 for passing the tab terminal 19 out of the casing 1, and the bottom lid 3 is provided with a notch 35 for leading the connecting terminal 21 out of the casing 1. The tab terminal 19 can be used for connecting a lead wire thereto via a suitable connector, and the connecting terminal 21 is adapted to be fitted into a hole formed in a printed circuit board and soldered thereto. The neck portion 16*b* further includes a securing bracket 16*c* (FIG. 2) provided with a pair of openings for securing the moveable end terminal piece 16 to the case main body 2 by fitting a pair of projections 25 provided in the casing main body 2 into these openings, and thermally crimping these projections 25.

The fixed end terminal piece 17 is provided with a tab terminal 20 at its upper end, a neck portion 7*f* bent rearward from the base end of the tab terminal 19 and received in a recess 24A received in the upper wall 2*b*, a main part 17*e* extending downward from the neck portion 17*f*, and received in a groove 24B provided in a corner portion between the rear wall 2*e* and one of the side walls 2*d*, and a connecting terminal 22 provided at the lower end of the main part 17*e*. The cover 30 is provided with an opening 32 for passing the tab terminal 20 out of the casing 1, and the bottom lid 3 is provided with a notch 36 for leading the connecting terminal 22 out of the casing 1. The tab terminal 20 can be used for connecting a lead wire thereto via a suitable connector, and the connecting terminal 22 is adapted to be fitted into a hole formed in a printed circuit board and soldered thereto. The upper end of the main part 17*e* adjoining the neck portion 17*f* is provided with a lateral extension 17*d* which consists of a base end 17*c* extending toward the moveable end terminal piece 16, a narrowed portion 17*b* bent into the recess 24A, and a mounting portion 17*a* formed in a free end portion of the narrowed portion 17*b*. Thus, the base end 17*c* having a relatively narrow width extends along one side of the fixed contact 18.

Figure 4:
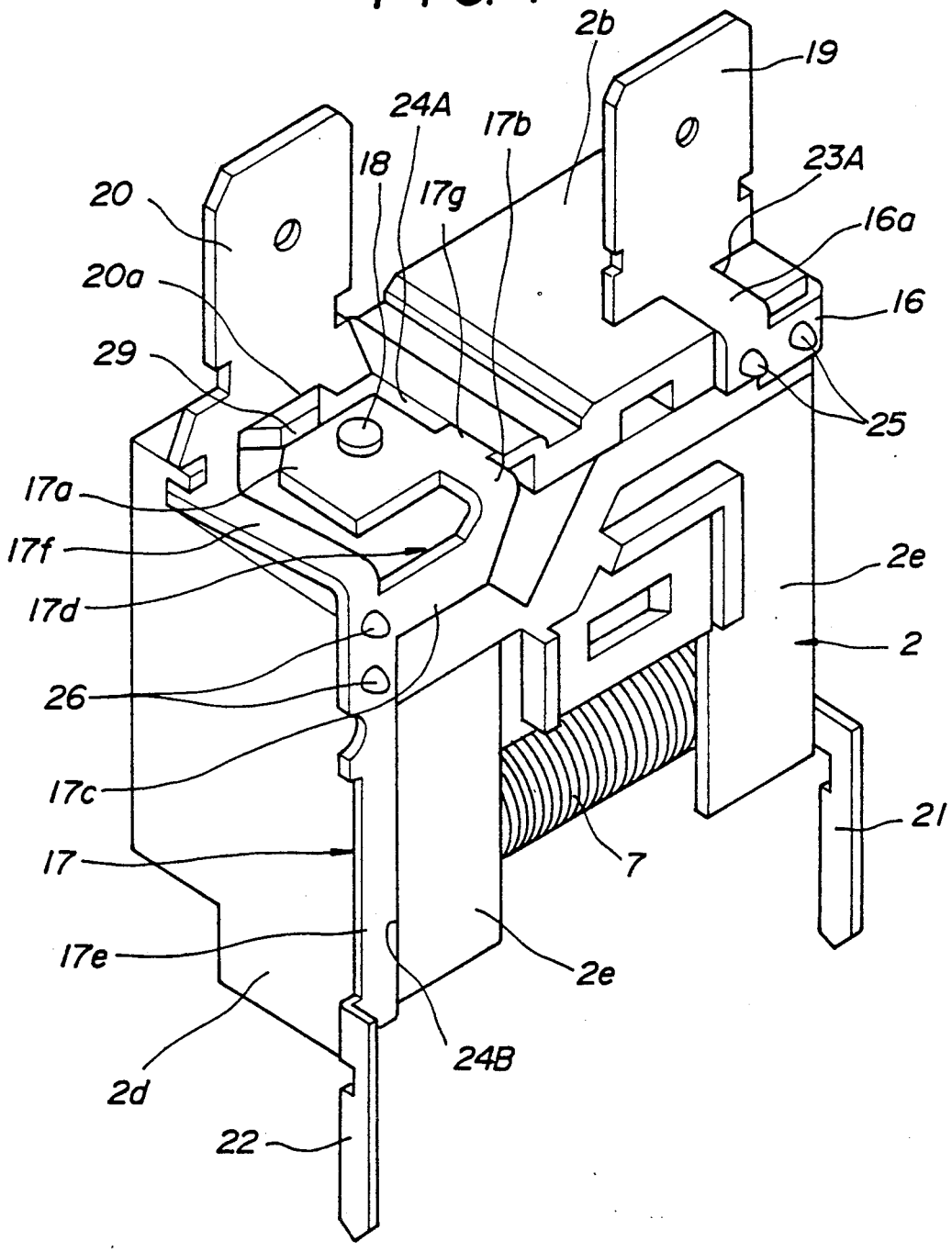
FIG. 4 is a rear perspective view of the internal structure of this electromagnetic relay.

The narrowed portion is provided with a projection 17*g* which abuts a side wall of the recess 24A, and the rear wall of the front wall (rear wall as seen in FIG. 4) is provided with a projection 29 which abuts an edge of the mounting portion 17. The projections 17*g* and 29 define the position of the mounting portion 17*a* from two mutually perpendicular directions, and accurately define the position of a fixed contact 18 mounted on this mounting portion 17*a*. The upper end of the main part 17*e* is provided with a pair of openings for securing the fixed end terminal piece 17 to the casing main body 2 by fitting a pair of projections 26 provided in the casing main body 2 into these openings, and thermally crimping these projections 26.

Numeral 28 denotes an insertion slit formed in the rear surface of the case main body 2 for positioning the fixing bracket 27, and numeral 29 denotes a positioning projection formed in the case main body 2 and adapted to be fitted into a notch 20*a* of the tab terminal 20.

The neck portion 16*a* of the moveable end terminal piece 16 is further provided with a mounting bracket 27 bent perpendicularly therefrom, and this mounting bracket 27 fixedly secures a base end 14*b* of the moveable contact piece 14. The moveable contact piece 14 carries a moveable contact 15 at its free end 14*a* opposite to the fixed contact 18, and these contacts 15 and 18 are normally in contact with each other under the spring force of the moveable contact piece 14 itself.

Figure 5:
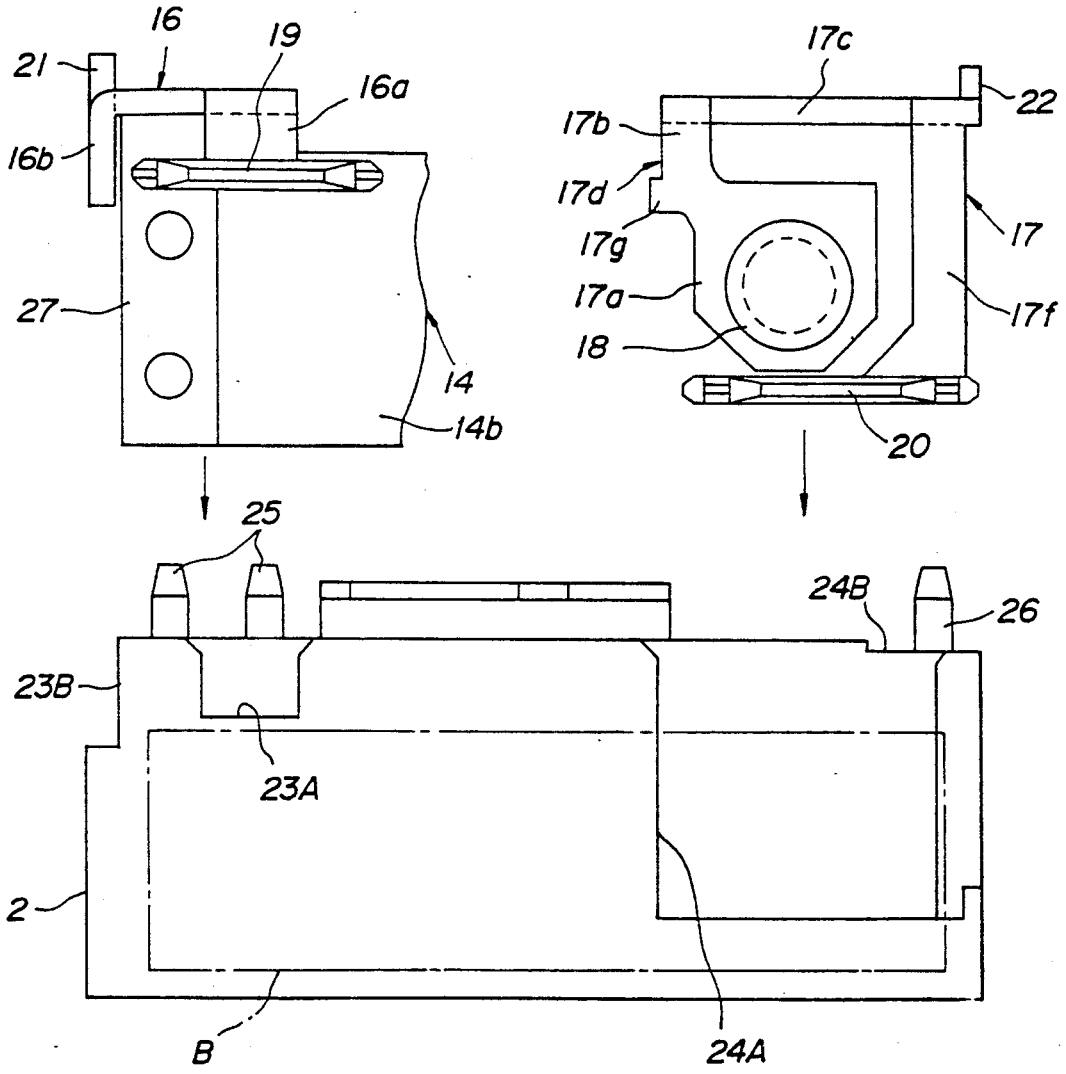
FIG. 5 is a fragmentary plan view illustrating the mode of assembling the terminal pieces into the appropriate grooves and recesses formed in the casing main body of this electromagnetic relay.

In assembling this electromagnetic relay, the moveable end terminal piece 16 and the fixed end terminal piece 17 may be simply fitted into the corresponding recesses and grooves 23A, 23B, 24A and 24B from the back of the case main body 2 as illustrated in FIG. 5, and secured therein by thermally crimping the projections 25 and 26.

When the electromagnetic coil 7 is energized, the iron core 5 is magnetized, and the main part 10*a* of the armature 10 is attracted to the magnetic pole 5*b* with the result that the armature 10 undergoes a rotative movement. Therefore, the card 13 provided on the other leg 10*b* of the armature 10 bears upon the moveable contact piece 14, and the moveable contact 15 comes into contact with the fixed contact 18.

When the electromagnetic coil 7 is de-energized, the attraction of the iron core 5 upon the armature 10 is removed and the armature 10 returns to its initial position under the spring force of the hinge spring 11 with the result that the moveable contact 15 is moved away from the fixed contact 18.

Since the grooves 23B and 24B for receiving the main parts 16*b* and 17*e* of the moveable end and fixed end terminal pieces 16 and 17 are formed opposite to or remote from the opening 2*a* of the recess 2A accommodating the electromagnet block B, the exposed surface of the electromagnet block B and the exposed surfaces of the terminal pieces 16 and 17 are arranged in opposite parts of the casing 1, and a sufficient insulating distance can be ensured without any difficulty.

Also, since the base end 17*c* is provided in the fixed end terminal piece 17, and the mounting portion 17*a* for the fixed contact 18 is formed in the free end of the base end 17*c* by way of the narrowed portion 17*b*, even when an external pushing force is applied on the tab terminal 20, the position of the fixed contact 18 can be maintained, and the operating characteristics can be prevented from being impaired.

Figure 6:
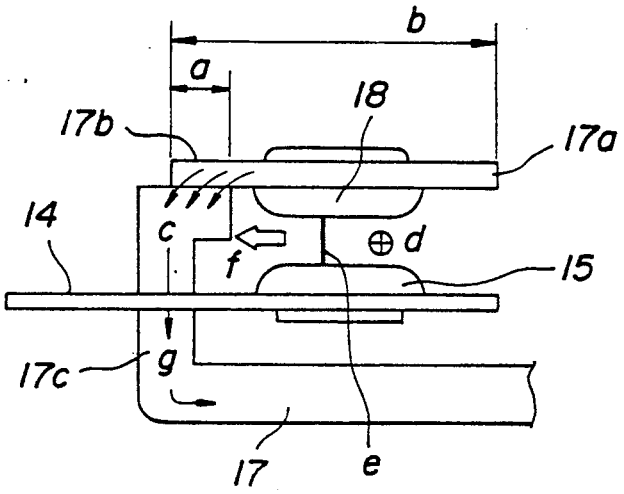
FIG. 6 is a view illustrating the structure in the vicinity of the fixed contact of the electromagnetic relay.

Further, since the narrowed portion 17*b* having the width a which is narrower than the width b of the mounting portion 17*a* for the fixed contact 18 is formed in the fixed end terminal piece 17 as illustrated in FIG. 6, the increase in the density of the current C constricted by this narrowed portion 17*b* induces a strong magnetic field d in its proximity, and the arc e which is generated when the moveable contact 15 moves away from the fixed contact 18 and passes through the magnetic field d is subjected to an electromagnetic force f which tends to move the arc e sideways. The generation of this electromagnetic force f counteracts the tendency of the arc e to be concentrated in the shortest path between the opposing surfaces of the two contacts 18 and 15, and the durability of the contact mechanism A can be improved by effectively preventing the melting of the contacts as well as welding together of the contacts due to excessive heat generation.

Further, according to this embodiment, since electric current g also flows through the U-shaped base end 17*c* extending along one side of the fixed contact 18, and this further increases the magnetic flux in the magnetic field d, the effect of moving or eliminating the arc e can be improved even further.

One end of each of the moveable end and fixed end terminal pieces 16 and 17 was formed as a tab terminal 19 or 20, and its other end was formed as a connecting terminal 21 or 22 for a printed circuit board in the above described embodiment, but these end portions may also be provided with terminals of other types.

Figure 7:
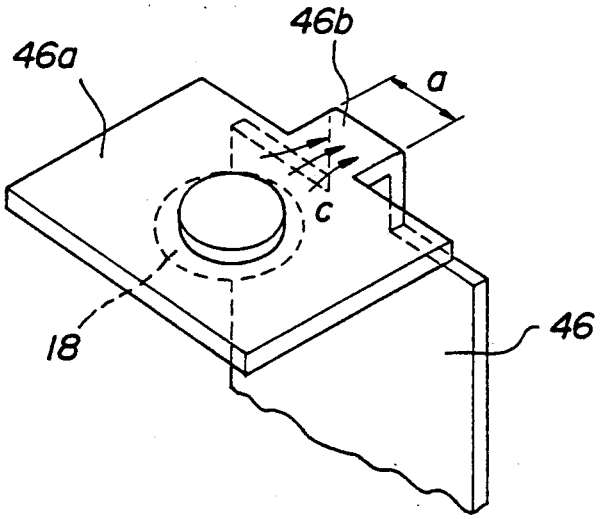
FIG. 7 is a fragmentary perspective view showing an alternate embodiment of the contact mounting structure for the fixed end terminal piece according to the present invention.

FIG. 7 shows an alternate embodiment of the mounting portion structure for a fixed contact 18. A mounting portion 46*a* is perpendicularly bent from a main part of a fixed end terminal piece 46, and these two parts 46*a* and 46 are connected together by a bent neck portion 46*b* having a reduced width a. This embodiment is not provided with a section of the fixed end terminal piece 46 which extends along the fixed contact 18, but the neck portion 46*b* serves as a narrowed portion where electric current is concentrated so as to produce a strong magnetic field in the proximity of the fixed contact 18.

Although the present invention has been described in terms of specific embodiments, it is possible to modify and alter details thereof without departing from the spirit of the present invention.

What we claim is:

1. An electromagnetic relay, comprising a casing, an electromagnet block received in said casing, and a contact unit provided in an upper part of said casing so as to be actuated by said electromagnet unit, said contact unit comprising:

a fixed end terminal piece secured in said casing and provided with a mounting portion carrying a fixed contact;

a moveable end terminal piece secured in said casing;

a movable contact piece resiliently supported by said moveable end terminal piece at its base end and carrying a moveable contact at its free end for selective engagement with said fixed contact in cooperation with said electromagnet unit;

said mounting portion being provided with a main part lying in a plane and a narrowed part having a narrower width than said main part, wherein said narrowed part includes a section which extends along one side of said fixed contact in the plane of said main part, and wherein at least a portion of said narrowed part between said main part and said section lies in a plane perpendicular to the plane of said main part.

2. An electromagnetic relay according to claim 1, wherein said casing is provided with a first side defining an open end for receiving said electromagnet block therefrom, and said contact unit is disposed in an upper part of said casing, said terminal pieces extending from said upper part to a lower part of said casing along grooves defined in a second side of said casing remote from said first side.

3. An electromagnetic relay according to claim 2, wherein said casing is box-shaped, and said grooves are defined along ridges on either side of said second side of said casing.

4. An electromagnetic relay according to claim 3, wherein each of said terminal pieces extends vertically entirely across said casing, and each of upper and lower extreme ends of each of said terminal pieces projects from said casing to form a terminal for connection with an external circuit.

5. An electromagnetic relay according to claim 2, wherein the plane of said main part is perpendicular to a vertical direction of said casing.

6. An electromagnetic relay according to claim 1, wherein said casing is provided with a recess for receiving said mounting portion, side walls of said recess abutting side edges of said mounting portion from two mutually perpendicular directions to locate said fixed contact carried by said mounting portion.

* * * * *